US005277169A

United States Patent [19]

Magnuson

[11] Patent Number: 5,277,169

[45] Date of Patent: * Jan. 11, 1994

[54] BALL LAUNCHING AND CATCHING TOY AND GAME

[76] Inventor: Eric E. Magnuson, 13218 Jessica Dr., Spring Hill, Fla. 34609

[ * ] Notice: The portion of the term of this patent subsequent to Jul. 7, 2009 has been disclaimed.

[21] Appl. No.: 908,400

[22] Filed: Jul. 6, 1992

Related U.S. Application Data

[63] Continuation-in-part of Ser. No. 401,005, Aug. 31, 1989, Pat. No. 5,127,389, which is a continuation-in-part of Ser. No. 36,691, Apr. 6, 1987, Pat. No. Des. 305,342.

[51] Int. Cl.[5] ..... F41B 3/02

[52] U.S. Cl. ..... 124/20.1; 124/1; 273/346

[58] Field of Search ..... 124/1, 16, 17, 20.1, 124/41.1, 80; 446/26, 429; 273/346

[56] References Cited

U.S. PATENT DOCUMENTS

| | | | |
|---|---|---|---|
| 3,802,409 | 4/1974 | Mike et al. | 124/20.1 |
| 4,240,396 | 12/1980 | Randoll | 124/17 |
| 4,240,639 | 12/1980 | Bolton et al. | 273/346 |
| 4,789,161 | 12/1988 | Waskelo | 273/346 X |
| 4,836,554 | 6/1989 | Robbins | 273/346 X |
| 4,995,617 | 2/1991 | Lee | 273/346 |
| 5,085,442 | 2/1992 | Lee | 273/346 |
| 5,127,389 | 7/1992 | Magnuson | 124/17 |
| 5,154,515 | 10/1992 | Haynes | 124/20.1 |

*Primary Examiner*—Randolph A. Reese
*Assistant Examiner*—John Ricci
*Attorney, Agent, or Firm*—Charles A. McClure

[57] ABSTRACT

Ball launching and catching toy and game including launching a fuzzy ball from a slingshot type of launcher, and catching the fuzzy ball with a mitt having a retentive surface. The preferred launcher includes a pair of stretchable elastic members flanking a pocket member having a topside adapted to carry a fuzzy ball to be launched and an underside with an attached loop, and including as launching steps gripping the pair of stretchable elastic members and engaging the loop of the pocket member with the fuzzy ball lying thereon, and stretching the elastic members upward and outward from the pocket member, then disengaging the loop and thereby enabling the stretched members to contract, thus launching the ball from the pocket member. The mitt may be separate or attached to a launcher.

6 Claims, 2 Drawing Sheets

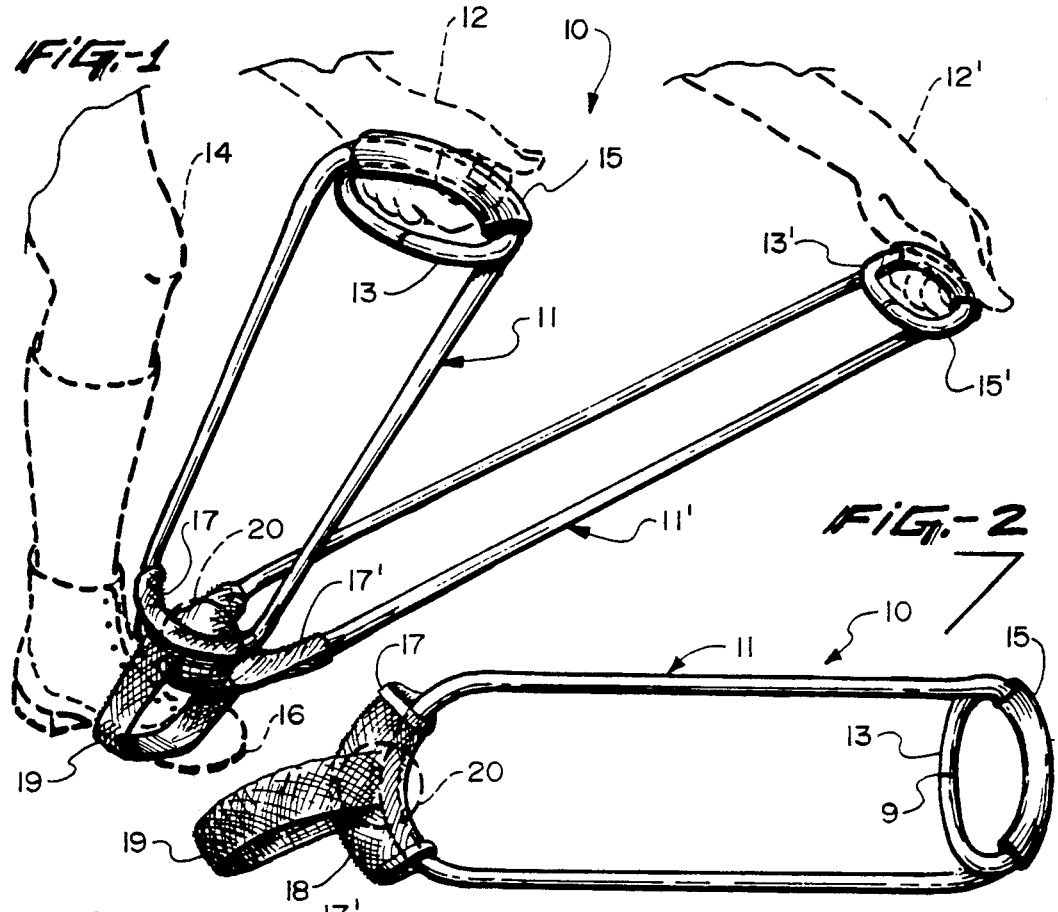
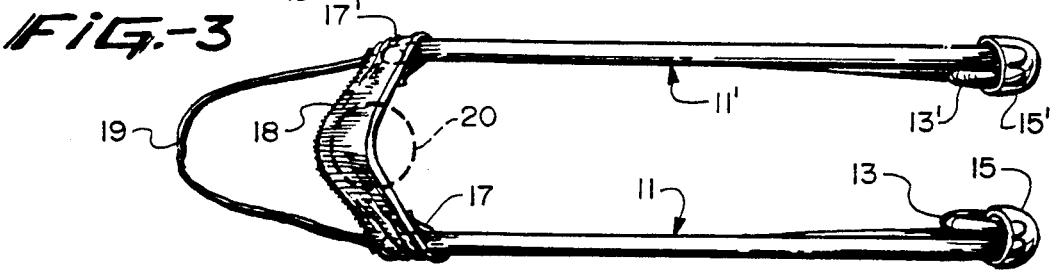
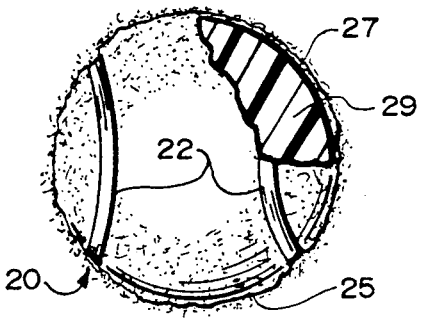
FIG.-4
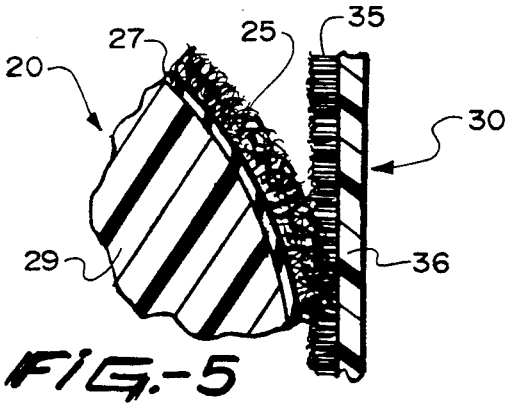
FIG.-5

BALL LAUNCHING AND CATCHING TOY AND GAME

This is a continuation-in-part of my copending application, Ser. No. 401,005 filed 31 Aug. 1989, to issue as U.S. Pat. No. 5,127,389, which was a continuation-in-part of my application Ser. No. 36,691 filed Apr. 6, 1987 and now U.S. Des. Pat. No. 305,342.

TECHNICAL FIELD

This invention concerns a ball launching and catching toy/game.

BACKGROUND OF THE INVENTION

The slingshot has been known since time immemorial as a weapon and a toy. My noted patents illustrate a modern slingshot type of launcher for substantially spherical toy missiles (water balloons, for example) and how they can be propelled over an extended distance by a single person using both hands and one foot to stretch and aim the launcher while standing on the other foot. Of course, several persons can combine to use such a launcher, one each for holding the respective stretchable members by respective hand grips, and another one to pull the missile pocket to stretch those members preparatory to launching the toy missile—as the missile pocket is released to enable the stretched members to contract rapidly for launching.

Catching toy missiles from that sort of launcher has been quite impractical because of their structure, the speed they attain, and their force of impact—at least for many or most of the children who undertake to use the launcher. Overcoming the catching difficulty could enhance the fun of the improved launching method for many.

SUMMARY OF THE INVENTION

A primary object of the present invention is to provide methods of modified slingshot launching and catching of given toy missiles.

Another object of this invention is to enable persons to launch a toy missile directly upward and then catch it.

A further object of the invention is to enable the operators of two or more such launchers to play a back-and-forth or round-robin game of launching and catching a suitable toy missile.

In general, the objects of this invention are accomplished by modified slingshot launching of a tennis (or similarly fuzzy) ball and catching it with a mitt having an immediately retentive surface.

More particularly, a game of catch can be played by a plurality of persons each equipped with such a modified slingshot launcher and a fuzzy-ball-retaining mitt. Alternatively, one person so equipped can so catch such a fuzzy ball after launching it nearly vertically.

SUMMARY OF THE DRAWINGS

FIG. 1 is a perspective view of a toy missile-launcher according to this invention, shown partially stretched by a person whose hands and one leg and foot are fragmentarily shown in broken lines;

FIG. 2 is a side elevation of such a toy missile-launcher, shown unstretched; and FIG. 3 is a front elevation of the same launcher, unstretched.

FIG. 4 is an elevation of an appropriately fuzzy ball, partly sectioned away to show a bit of the interior structure;

FIG. 5 is an elevational detail, greatly enlarged, of retentive engagement of the surface fibers of a fuzzy ball by a mitt having an unsheared pile of tufted filaments extending from a mitt surface;

DESCRIPTION OF THE INVENTION

Figure 6A:
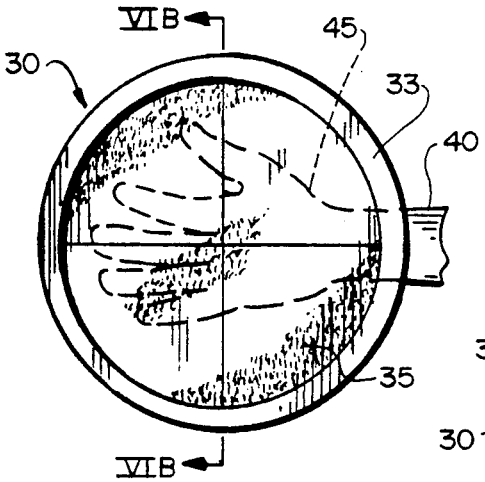
FIG. 6A is a front elevation of a mitt with a retentive surface useful according to this invention.

FIG. 1 shows elastic missile-launching toy 10 of this invention being held in stretched condition by a person fragmentarily shown in broken lines. Hands 12 (right) and 12' (left) of such person are holding right and left sleevelike flexible hand grips 15, 15' surrounding part (approximately half) of small loops 13, 13' in endless larger loops of stretchable elastic propulsion means, here in the form of individual tubular members 11, 11'. At their opposite ends the tubular members are covered by sleeves 17, 17' of pliable pocket member 19, in the form of a generally rectangular fabric band or the like, shown here carrying ball 20 (in broken lines) on its topside. Attached at its ends to (hanging below) respective side edges of the pocket is loop 19 shown engaged as a stirrup by boot 16—on the foot of leg 14 of such person. Vector V (with arrow) points away from missile 20 toward the track the missile will take when launched.

FIGS. 2 and 3 show toy missile-launcher 10 at its unstretched normal length in respective side (right) and front elevational views —as they would appear to such a person standing at the left side edge looking down as though the launcher were lying on the ground. Missile 20 still appears (in broken lines) lying against the topside of pocket member 18. Tubing seam or join 9 is barely visible as a short continuous line transversely across the inner part of small loop 13 where the former ends of large loop 11 of tubing have been joined together, as by being heat-sealed or welded.

FIG. 4 shows, on an enlarged scale, ball 20 with characteristic smooth (nap-free) continuous U-shaped seam 22 and otherwise fuzzy outer surface or nap 21 similar to that of a tennis ball—partly cut away to show familiar cover 27 with adjacent resilient interior 29, together thicker than usual in a tennis ball. Though its structure is not apparent here, the nap preferably comprises a multiplicity of tufted loops, as distinguished from the familiar shorter sheared nap of a tennis ball. Other nap structures may be similarly effective.

FIG. 5 shows on a further enlarged scale the outer surface of fuzzy ball 20 "caught" by the mitt 30. Tufted or "loopy" nap 25 of ball 20 is entangled by relatively stiff "hooked" filaments rising from backing 36 of mitt 30. As identified, a "fuzzy" ball is one with the described loopy nap (or equivalent) adapted to be retained by such hooked filaments upon impact. Such "hook-and-loop" fastener engagement is familiar to members of public from articles introduced under the brand name "VELCRO" and now present in numerous clothing fasteners, and other situations requiring disengageable engagement.

FIG. 6A shows mitt 30 face-on, featuring circular rim 33 surrounding a catching surface 35. Hand 45 (dashed lines) behind the mitt, and wrist 40 visible out from behind it at the right, suggest how the mitt is held for use.

Figure 6B:
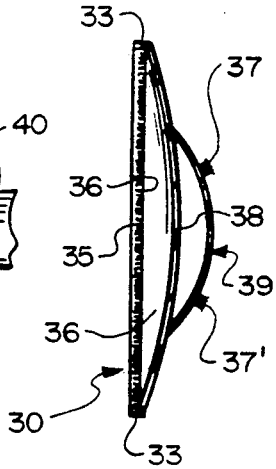
FIG. 6B is a transverse sectional elevation (partly cut away) through such mitt, taken at VI—VI on FIG. 5.

FIG. 6B shows mitt 30 in transverse sectional elevation along VI—VI on FIG. 5. Front hooked surface 35, rising from backing 36, and smooth rear surface 38 are joined along their perimeter by rim 33. Strap 39 connected to the smooth rear surface admits the fingers of a player (not shown here, indicated in FIG. 6A). Two fasteners 37, 37' (hook-and-loop, or other) at the back of the strap enable it to be attached elsewhere, as shown in the next view.

Figure 6C:
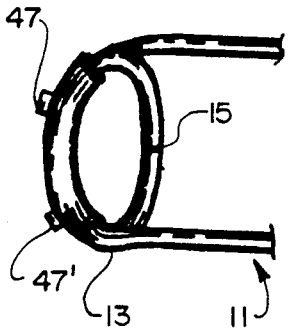
FIG. 6C is a transverse elevation of attachment of the mitt to a hand grip of the toy-missile launching means.

FIG. 6C shows in side elevation (as in FIG. 2, but oppositely directed) part of stretchable member 11, including loop 13 and hand grip 15. Two fasteners 47, 47' on the handle are adapted to attach to pair of fasteners 37, 37' on mitt 30 in FIG. 6B, whether by hook-and-loop, snap, or other disengageably engageable means.

Operation of the launcher is self-evident from the showing in FIG. 1 and the foregoing description. The direction of take-off is determined by the launching player, as by altering extension of arms and legs appropriately. Care should be taken by every launcher to keep all body parts away from the ball trajectory. An initial track is exemplified by vector V. Wearing safety goggles is recommended.

It is apparent that when a ball is in place on the topside of the pocket member, and the elastic propulsion members are stretched as shown, a tipping upward of the foot engaging the stirrup loop disengages it, whereupon the stretched members are enabled to contract rapidly to normal length (or momentarily less) launching the ball.

Figure 7A:
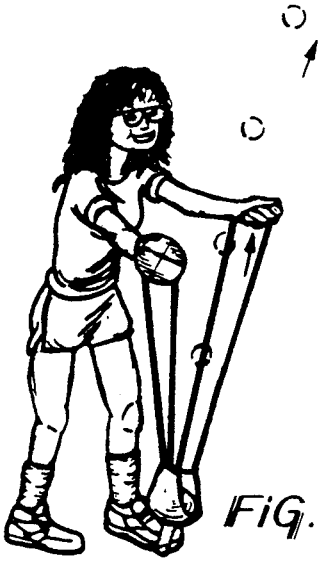
FIG. 7A is a schematic perspective view of a single player in the act of launching a fuzzy ball substantially vertically from such a launcher.
Figure 7B:
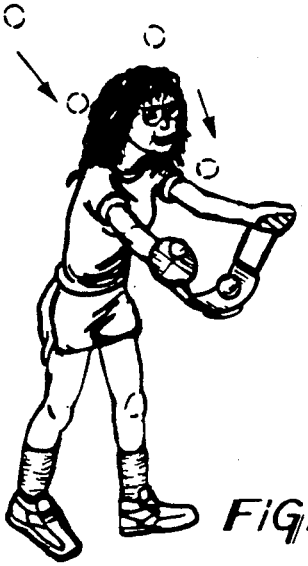
FIG. 7B is a schematic perspective view of the same player in the act of catching the fuzzy ball so launched.
Figure 8:
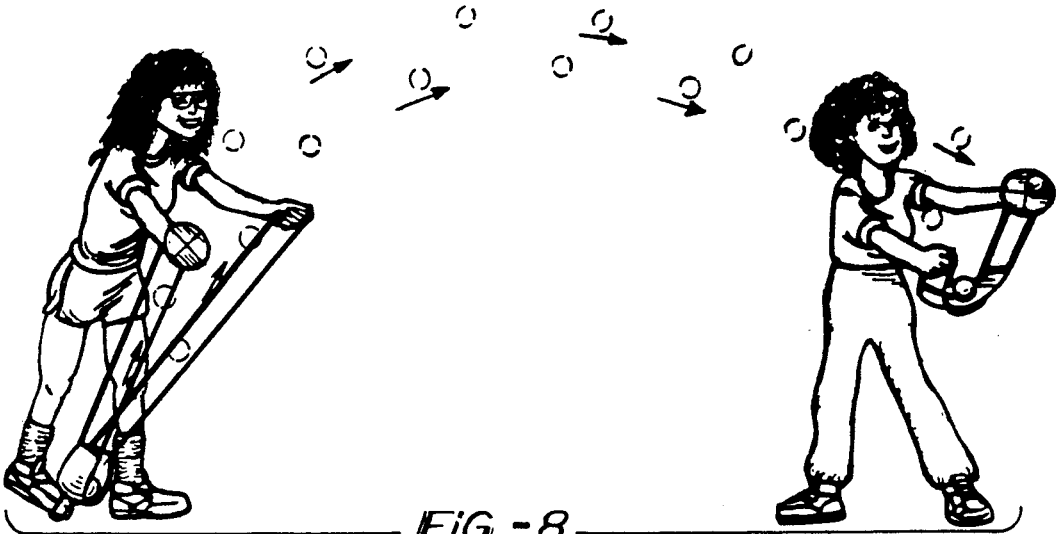
FIG. 8 is a schematic view of two players, each with a launcher and a retentive mitt, playing catch.

The next several views are schematic diagrams of games of catch played by one or more players using the launcher and/or the mitt. Successions of small circles indicate likely trajectories. It will be understood that a single player, if skillful enough, can launch a ball as in FIG. 7A upward and forward (preferably nearly vertically) and then run to catch it as in FIG. 7B. Alternative trajectories are shown for the illustrated over-the-shoulder catch, onto the mitt or into the launcher pocket. As shown in FIG. 8, two balls may be launched simultaneously and perhaps even caught simultaneously, such as one by the mitt and another in the launcher pocket. Multiple players similarly equipped can play catch by launching the ball and catching the ball alternately back and forth. As any number can play, a round robin of several players may occur, appropriately equipped to launch and catch the ball, and throw or launch it back.

Especially for children not too adept at catching a ball, with or without a ball glove, the combination of a launcher usable by one or more players and a mitt capable of retaining a suitable ball upon impact makes for an irresistible toy and game. To catch the ball, a player need only intercept the trajectory of the ball with the mitt, and the fuzzy ball is retained in readily disengageable engagement.

Readily available natural and synthetic materials are suitable for the components of this toy or game. Thus, the launcher pocket is preferably made of a natural or synthetic, woven or non-woven textile fabric, although a pliable film would suffice. The tubing may be any suitably elastomeric composition, such as a natural or synthetic rubber. The hand grips preferably are made of somewhat less stretchable material, such as a polyhydrocarbon (e.g., polyethylene or polypropylene). The mitt is made of molded plastic or textile material and includes a catching surface adapted to retain a fuzzy ball upon impact. The catching surface is covered with numerous stiff upright filaments hooked or otherwise enlarged on their outer ends, preferably in various directions, and suitably composed of a thermoplastic polymer such as polyvinyl chloride. When the loopy nap of a fuzzy ball is engaged by those stiff filaments, friction of such engagement is sufficient to retain the ball against the mitt in the absence of forceful manual disengageent of the ball therefrom.

Preferred embodiments and variants have been suggested for this invention. Other modifications may be made, as by adding, combining, deleting, or subdividing compositions, parts, or steps, while retaining all or some of the advantages and benefits of the present invention—which itself is defined in the following claims.

The claimed invention is:

1. Method of playing a game of catch comprising the steps of launching a fuzzy ball from a slingshot type of launcher, and catching the fuzzy ball with a mitt having a retentive surface;

wherein the slingshot type of launcher has a pair of stretchable elastic members flanking a pocket member with a topside adapted to carry a fuzzy ball and an underside with an attached loop, including the single-person launching steps of gripping the pair of stretchable elastic members by hand, balancing on one foot while engaging with the other foot the loop of the pocket member with the topside holding a launchable fuzzy ball, stretching the elastic members upward and outward from the pocket member, then disengaging the foot from the loop after stretching the elastic members, thereby enabling the stretchable members to contract and launch the ball.

2. Method according to claim 1, wherein the slingshot type of launcher includes a mitt adapted to catch and retain a fuzzy ball upon impact, and including as a catching step interposing the mitt into the path of a fuzzy ball so launched, and so catching the ball upon impact thereof against the mitt.

3. Method of playing a game of catch comprising the steps of launching a fuzzy ball from a slingshot type of launcher, and catching a fuzzy ball with a mitt having a retentive surface adapted to catch and retain a fuzzy ball upon contact;

wherein the mitt is attached to a gripped position of one of the stretchable members, and including detaching the caught fuzzy ball from the mitt, placing it in the pocket member and launching it to be caught again;

including as a catching step interposing the mitt into the path of a fuzzy ball so launched, and so catching the ball upon contact thereof with the mitt.

4. Ball game apparatus comprising in combination a slingshot type of launcher, a fuzzy ball launchable thereby, and a catching mitt having a surface adapted to retain the fuzzy ball upon contact;

wherein the launcher includes a pair of stretchable elastic members flanking a pocket member having a topside adapted to carry a fuzzy ball to be launched and an underside with an attached loop adapted to be engaged during stretching of the stretchable members upward and outward therefrom and then adapted to be disengaged to enable the stretched members to contract and thus launch the ball;

and wherein the catching mitt is connected to a hand-held part of one of the elastic members.

5. Game apparatus comprising combined launching and catching means for a fuzzy ball, including pocket means having top and bottom surfaces in use orientation, adapted to carry on the top surface a fuzzy ball readily launchable, and having a grippable loop in the vicinity of the bottom surface and adapted to be gripped by hand or by foot;

a pair of stretchable self-retracting launching members, one end of each being attached to the pocket member, and the other end of each being adapted to be gripped by hand; and a catching mitt being adapted to be connected to a readily gripped part of one of the launching members and having a surface adapted to retain a fuzzy ball upon forceful contact therewith.

6. Game apparatus comprising combined launching and catching means for a fuzzy ball, including pocket means having top and bottom surfaces in use orientation, adapted to carry on the top surface a fuzzy ball readily launchable, and having a grippable loop in the vicinity of the bottom surface and adapted to be gripped by hand or by foot;

a pair of stretchable self-retracting launching members, one end of each being attached to the pocket member, and the other end of each being adapted to be gripped by hand; and a catching mitt being connected to a readily gripped part of one of the launching members and having a surface adapted to retain a fuzzy ball upon forceful contact therewith.

* * * * *